US005695921A

United States Patent [19]

Krishnamurthy et al.

[11] Patent Number: 5,695,921

[45] Date of Patent: Dec. 9, 1997

[54] PHOTOGRAPHIC ELEMENTS WITH MAGENTA DYE FORMING COUPLERS AND STABILIZERS

[75] Inventors: Sundaram Krishnamurthy, Penfield; Paul Patrick Spara, Fairport; Rakesh Jain, Penfield, all of N.Y.

[73] Assignee: Eastman Kodak Company, Rochester, N.Y.

[21] Appl. No.: 627,652

[22] Filed: Apr. 4, 1996

Related U.S. Application Data

[63] Continuation of Ser. No. 414,564, Mar. 31, 1995, abandoned.

[51] Int. Cl.[6] ..... G03C 1/08

[52] U.S. Cl. ..... 430/551; 430/546; 430/554; 430/555; 430/558; 430/610

[58] Field of Search ..... 430/551, 546, 430/554, 555, 558, 610

[56] References Cited

U.S. PATENT DOCUMENTS

| | | | |
|---|---|---|---|
| H122 | 9/1986 | Kawagashi et al. | 430/546 |
| 3,676,137 | 7/1972 | Mizuki et al. | 430/546 |
| 4,278,757 | 7/1981 | Mukunoki et al. | 430/512 |
| 4,326,022 | 4/1982 | Ito et al. | 430/546 |
| 4,430,422 | 2/1984 | Van De Sande et al. | 430/377 |
| 4,749,645 | 6/1988 | Goddard et al. | 430/551 |
| 4,794,072 | 12/1988 | Goddard | 430/546 |
| 4,882,267 | 11/1989 | Hirabayashi et al. | 430/546 |
| 4,920,126 | 4/1990 | Sata et al. | 430/546 |
| 5,108,886 | 4/1992 | Idogaki | 430/546 |
| 5,120,636 | 6/1992 | Takahashi et al. | 430/546 |
| 5,134,059 | 7/1992 | Kunitz et al. | 430/554 |
| 5,250,407 | 10/1993 | Kase | 430/555 |
| 5,356,763 | 10/1994 | Takahashi et al. | 430/551 |
| 5,462,848 | 10/1995 | Merkel et al. | 430/555 |

FOREIGN PATENT DOCUMENTS

| | | | |
|---|---|---|---|
| 2254147 | 11/1987 | Japan | 430/546 |
| 2032340 | 2/1990 | Japan | 430/555 |
| 4184436 | 4/1992 | Japan | 430/610 |
| 5181225 | 7/1993 | Japan | 430/610 |
| 93/07534 | 4/1993 | WIPO . | |

*Primary Examiner*—Janet C. Baxter
*Attorney, Agent, or Firm*—Arthur E. Kluegel

[57] ABSTRACT

A silver halide photographic element comprising a magenta dye forming coupler and a compound of formula (A) associated with the coupler:

$$\mathrm{ArO{-}P({=}O)(OR^{20})_2} \qquad \text{(A)}$$

wherein:

each $R^{20}$ independently represents an alkyl, alkenyl, or heteroaryl group;

Ar represents an aryl or heteroaryl group. Photographic elements of the present invention exhibit low thermal pinking, while still having good image stability and hue.

5 Claims, No Drawings

PHOTOGRAPHIC ELEMENTS WITH MAGENTA DYE FORMING COUPLERS AND STABILIZERS

This is a Continuation of application Ser. No. 08/414,564, filed Mar. 31, 1995, now abandoned.

FIELD OF THE INVENTION

This invention relates to the stabilization of magenta dye images in processed photographic elements. Particularly, it relates to phosphate esters bearing both aryl and alkyl groups and their utility in controlling the Dmin pinking.

BACKGROUND OF THE INVENTION

In a silver halide photographic element, a color image is formed when the material is exposed to light and then subjected to color development with a primary amine developer. The color development results in imagewise reduction of silver halide and production of oxidized developer. The oxidized primary amine developer subsequently reacts with one or more incorporated dye-forming couplers to form dye in an imagewise fashion. Some couplers, referred to as DIR couplers, release a development inhibitor compound or fragment upon coupling with the oxidized primary amine developer. Further, some of these DIR couplers release the inhibitor compound or fragment with a time delay. These are sometimes referred to as DIAR couplers.

A variety of magenta dye-forming coupler types have been used in color photographic materials. Both 2-Equivalent and 4-equivalent pyrazolone magenta dye forming couplers are known. Couplers are 2-equivalent where they require a total of 2 moles of silver to be developed to produce 1 mole of dye. Such couplers are advantageous over similar 4-equivalent couplers in that more dye is produced from the same amount of developed silver.

Unreacted coupler typically remains following exposure and processing of a photographic element, in any area of the element which did not receive sufficient green light exposure to cause all of a magenta coupler to react with oxidized developer. Such unreacted coupler can react to cause color changes in the processed element over time. Such changes are particularly noticeable in areas which received little or no green light exposure since the processed element in those areas, would have little or no magenta dye. In the case of pyrazolone couplers, including in particular 2-equivalent pyrazolone couplers, there is a tendency to form a pink stain over time particularly due to exposure of the processed element to heat ("thermal discoloration", sometimes referenced as "pinking" or "thermal pinking").

Stabilizers are classes of compounds which reduce the image dye performance problem. Such stabilizers include phenols, bis-phenols, blocked phenols, blocked bis-phenols, metal and other organic complexes and other compounds, all of which have been described for use in conjunction with various color couplers. It is known in the color photographic art that high boiling organic phosphate esters can reduce the deterioration of the image stability of magenta dyes from light, heat, and humidity. For example, the following patents disclose various types of phosphate solvents which can be used with various couplers: U.S. Pat. No. 4,326,022; U.S. Statutory Invention Registration H122; U.S. Pat. No. 4,278,757; U.S. Pat. No. 4,430,422; U.S. Pat. No. 4,882,267; U.S. Pat. No. 4,910,126; U.S. Pat. No. 5,108,886; U.S. Pat. No. 5,120,636; U.S. Pat. No. 4,749,645; and U.S. Pat. No. 4,794,072. However, most of the solvents disclosed are either trialkyl- or triarylphosphates, all three substituents being identical. Unfortunately, such symmetrical solvents (both trialkyl and triaryl) do not adequately reduce the problem of pink stain produced in the thermal aging process.

It would be desirable then, to provide silver halide photographic materials comprising magenta couplers and phosphate ester coupler solvents bearing specific substituent groups capable of reducing green Dmin (thermal pinking), while not unduly affecting image dye stability and hue.

SUMMARY OF THE INVENTION

A silver halide photographic element is provided, which comprises a magenta dye forming coupler and a compound of formula (A) associated with the coupler:

$$\mathrm{ArO{-}P({=}O)(OR^{20})_2} \qquad \text{(A)}$$

wherein:

each $R^{20}$ independently represents an alkyl, alkenyl, or heteroaryl group;

Ar represents an aryl or heteroaryl group.

Elements containing magenta image dyes and compounds of formula (A) in association therewith, are also provided by the present invention.

Photographic elements of the present invention exhibit low thermal pinking, while still having good image dye stability and hue.

EMBODIMENTS OF THE INVENTION

It should be noted that throughout this application a reference to any type of chemical "group" includes both the unsubstituted and substituted forms of the group described. Generally, unless otherwise specifically stated, substituent groups usable on molecules herein include any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the groups mentioned in this application, can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, propyl and the like. Further, with regard to any alkyl group, alkylene group or alkenyl group, it will be understood that these can be branched or unbranched and include ring structures.

In the present application, by a compound of formula (A) being "associated" with the magenta dye forming coupler, is meant that it is positioned in the element so that it is sufficiently close to the magenta coupler such that it can exert its stabilizing effect on the magenta dye formed from the coupler. Preferably this will mean that the compound of formula (A) is in the same layer of the photographic element as the magenta dye forming coupler. However, the compound of formula (A) could be located in a different layer of the element, for example, in a layer adjacent to the layer containing the magenta dye forming coupler. Similarly, in this application when one compound is referred to as being "associated" with another in a photographic element, this means that it is positioned with respect to that other compound so that it can have its intended effect (typically, they will be in the same layer).

In compounds of formula (A), preferably Ar is a phenyl group. Further, compounds of formula (A) are preferably of formula (B):

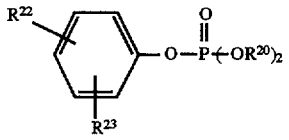

(B)

In formula (B) $R^{22}$ and $R^{23}$ are, independently, hydrogen, an alkyl group, alkenyl group, alkoxy group, aryloxy group, alkyl silyl group, an alkyl silyloxy group, alkylthio group, arylthio group, amido group, a carbamoyl group, an alkyl sulfonamido group, aryl sulfonamido group, aryl sulfuryl group, or alkyl sulfuryl group, provided that $R^{22}$ and $R^{23}$ are not both hydrogen. In particular, the total number of carbon atoms on $R^{22}$ and $R^{23}$ together is at least 5, and preferably from 5 to 30 carbon atoms in total.

Green Dmin control agents of the type of formula (A) or (B) above, can be synthesized by a procedure of the following type. Namely, a phenol of the formula (I) is reacted with an electrophilic phosphate reagent of formula (II) in the presence of a suitable base and suitable solvent to obtain the phosphate Green Dmin control agent of the formula (III).

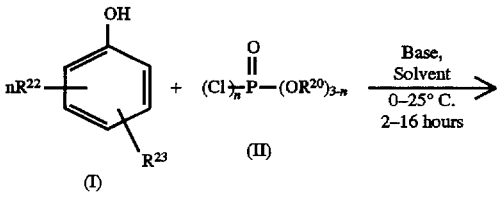

(I) (II)

-continued

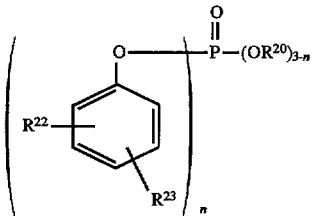

(III)

To specifically obtain compounds of formula (B), for example, using this synthesis, a starting compound of formula (II) would be selected in which n=1.

In the above reaction, a variety of electrophilic phosphorylating agents, $Cl_nP(O)(OR^{20})_{3-n}$, may be employed to generate control agents of formula (B) with diverse structural features.

The electrophiles will require a base for the formation of the control agents of formula (B). Bases employed are preferably organic tertiary amines such as triethylamine, and other organic bases like pyridine.

The preparation of compounds of formula (III) is preferably conducted in the presence of a wide range of solvents that are inert with respect to the reactants and products and satisfactorily dissolve the reactants: chlorinated hydrocarbons, hydrocarbons, ethers, esters, amides, sulfoxides, etc. Preferred reaction temperatures are in the range of 0° to 30° C. and the reaction times are in the range of 2 to 16 hours.

Examples of compounds of formula (A) are as follows:

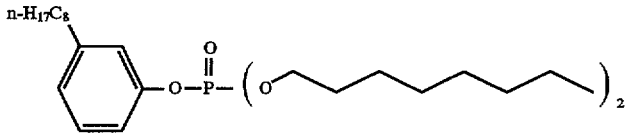

S-1

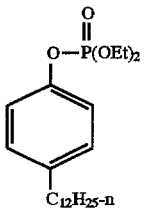

S-2

-continued
S-3
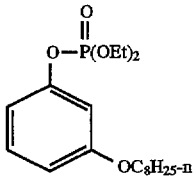
S-4
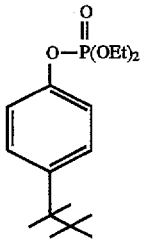
S-5
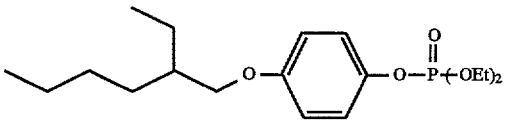
S-6
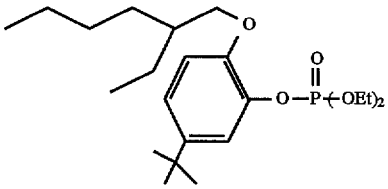
S-7
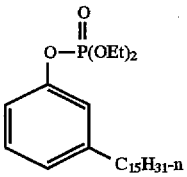
S-8
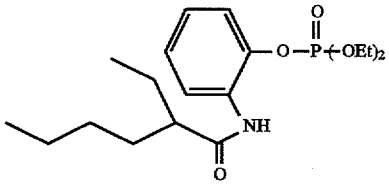
S-9
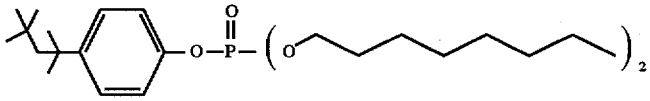
S-10
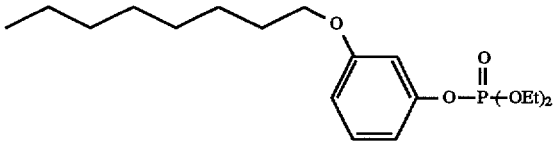
S-11
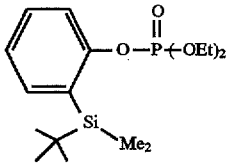

-continued

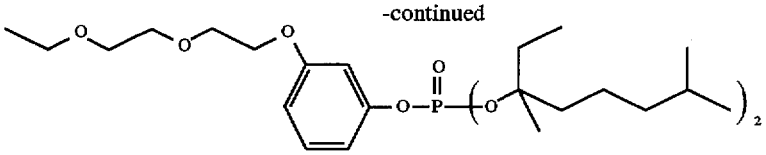

S-12

Most preferred Green Dmin control agent is of the formula:

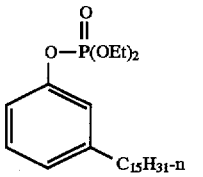

S-7

As to the magenta dye forming couplers used in elements of the present invention, broadly these include any compound which couples with primary amine oxidized developer to form a magenta dye. The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

Couplers that form magenta dyes upon reaction with oxidized color developing agent are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole- Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400.

Typical pyrazolotriazole and pyrazolone couplers are represented by the following formulas:

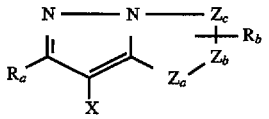

MAGENTA-1

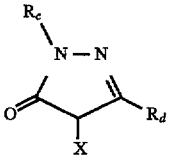

MAGENTA-2 wherein $R_a$ and $R_b$ independently represent H or a substituent; $R_c$ is a substituent (preferably an aryl group); $R_d$ is a substituent (preferably an anilino, acylamino, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Activated propene magenta couplers, examples of which can be found in European Patent Nos. 565,531; 572,422; and PCT publications WO 93/001523, WO 92/14189, WO 92/09010 and WO 93/07534. These references and all other patent documents or other references cited herein, are incorporated in the present application by reference. Particular activated propene magenta couplers are those disclosed in WO 93/07534 which may have the formula:

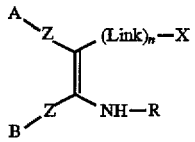

(1)

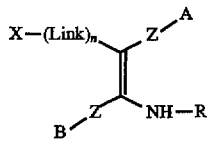

(2)

wherein A and B represent the same or different electron-withdrawing group,

X-(Link)$_n$— is H or a group which splits off from the carbon atom to which it is attached on coupling with oxidised color developer, R is an alkyl group, cycloalkyl group, aryl group or heterocyclic group, —$COR^1$, —$CSR^1$, $SOR^1$, $SO_2R^1$, —$NHCOR^1$, —$CONHR^1$, —$COOR^1$, —$COSR^1$, —$NHSO_2R^1$ wherein $R^1$ is an alkyl group, cycloalkyl group, or aryl group, and wherein two or more of A, B, R, and X optionally form part of a ring, but in one embodiment A does not form part of a ring with B, R, or X, Link is a linking group;

n is 0, 1 or 2; and

Z is a group that will extend the conjugated path from A or B to the —NH—R group while leaving the whole group electron-withdrawing, and has the formula:

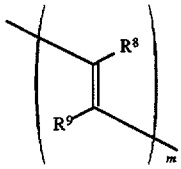

wherein $R^8$ and $R^9$ are each hydrogen, halogen, or an alkyl group or aryl group, or $R^8$ and $R^9$ may complete a carbocyclic or heterocyclic ring, and each m is independently 0, 1 or 2;

In one embodiment A and B of the above formulae (1) and (2) together may complete an electron-withdrawing heterocycle group. In another embodiment R and X together complete a heterocyclic ring group A and B may each individually represent an electron attractive group wherein the value of the Hammett substituent constant $\sigma_p$ (SIGMA$_p$ as defined by Hansch et al, *J. Med. Chem.*, 1973, 16, 1207; and ibid. 1977, 20, 304) is 0.03 or greater, preferably 0.35 or greater and more preferably 0.5 or above. Electron attractive groups generally, are those which have a positive $\sigma_p$. Hammett $\sigma_p$ values are also discussed in *Advanced Organic Chemistry* 3rd Ed., J. March, (John Wiley Sons, NY; 1985). Note that the "p" subscript refers to the fact that the $\sigma$ values are measured with the substituents in the para position of a benzene ring. Additional tables relating to Hammett $\sigma_p$ constants can be found in *Chemical Reviews Volume* 91, pages 165–195 (authored by C Hansch et al.).

Particular possible groups which each of the substituents may represent in formulas (1) and (2) above, the preparation of compounds of formula (1) and (2) and further more specific embodiments of such compounds and specific examples, are provided in WO 93/07534.

Pyrazolone couplers may particularly be of formula (D1) or (D2) below:

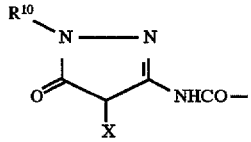

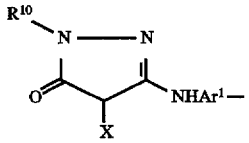

In the above formula (1) and (2) $R^{10}$ is a ballast or hydrogen, an alkyl group, aryl group, alkoxy group, alkoxycarbonyl group, alkanesulfonyl group, arenesulfonyl group, aryloxycarbonyl group, carbonamido group, carbamoyl group, sulfonamido group, or sulfamoyl group. $Ar^1$ is an aromatic group, for example a phenyl group. X is H or a group which leaves the pyrazolone ring upon coupling of the pyrazolone with oxidized developer.

Pyrazolone couplers of formula (D2) may also be of the more specific formula (D3):

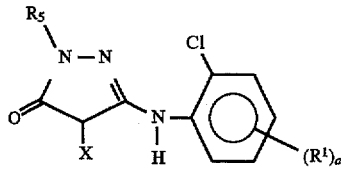

(D3)

In formula (D3): $R_5$ is an aryl group; X is H or a group which is cleaved upon reaction of the coupler with oxidized developer; a is an integer of from 0 to 4; and R' is a ballast. In any of formulae (D1), (D2) and (D3), any of the foregoing groups for $R^1$, $R^5$, $R^{10}$ or X, may particularly have 1 to 40, 1 to 30, 5 to 30, or 10 to 20 carbon atoms, except where the group has an aromatic ring present in which case it may particularly have from 6 to 40, 6 to 30, or 6 to 20 carbon atoms.

Particularly, this invention is most preferred when used in a color photographic silver halide element with a 5-pyrazolone photographic couplers represented by the following formula (D4):

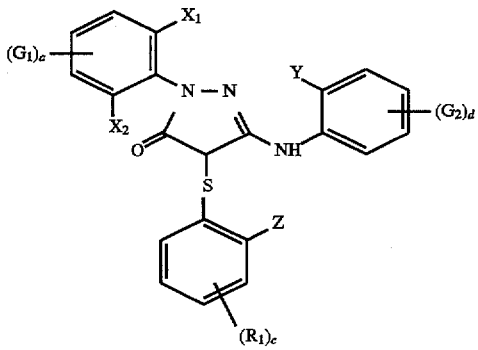

(D4)

wherein:

substituents $X_1$, $X_2$, Y, $G_1$ and $G_2$ are individually selected from the group of halogen, alkyl, alkoxy, aryloxy, acylamino, alkylthio, arylthio, sulfonamido, sulfamoyl, sulfamido, carbamoyl, diacylamino, alkoxycarbonyl, aryloxycarbonyl, alkoxysulfonyl, aryloxysulfonyl, alkylsulfonyl, arylsulfonyl, alkoxycarbonylamino, aryloxycarbonylamino, alkylureido, arylureido, acyloxy, nitro, cyano, trifluoromethyl and carboxy, and, in the case of $X_1$, $X_2$ and Y, hydrogen;

a, b and c are individually integers from 0 to3;

$R_1$ is selected from any of those groups which $G_1$ may represent, and hydroxyl;

Z is selected from carbamoyl, alkoxysulfonyl, aryloxysulfonyl, alkylsulfonyl, arylsulfonyl, alkoxycarbonyl, aryloxycarbonyl, sulfamoyl, acyloxy, nitro, cyano, and an amine group of the formula:

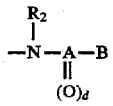

wherein:

$R_2$ is selected from the group consisting of hydrogen, alkyl, alkenyl, aryl, acyl, and heterocyclic;

A is carbon or a sulfur, and d is 1 when A is carbon and 1 or 2 when A is sulfur;

B is selected from alkyl, aryl, and heterocyclic groups, such group B bonded to A by an atom of oxygen, nitrogen, sulfur, or carbon of the group B, wherein in the case of a carbon bond, B has the formula:

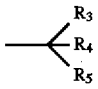

wherein $R_3$, $R_4$, and $R_5$ individually are selected from hydrogen, halogen, alkyl, aryl, heterocyclic group and W, wherein, W is selected from —$OR_6$, —$SR_6$, and —$NR_7R_8$, wherein $R_6$ is selected from alkyl, aryl, and heterocyclic groups, and $R_7$ and $R_8$ individually are selected from hydrogen, alkyl, aryl, acyl, alkylsulfonyl, arylsulfonyl and heterocyclic group, provided that when A is carbon at least one of $R_3$, $R_4$, and $R_5$ is not hydrogen or alkyl and provided that two of $R_3$, $R_4$, and $R_5$ may join to form an aliphatic, aromatic or heterocyclic ring.

Further particular structures and examples of magenta couplers of structure (D4) and their preparation, can be found in PCT publication WO 92/18902 (publication date Oct. 29, 1992).

Illustrative examples of the structures of magenta couplers are the following:

M-1

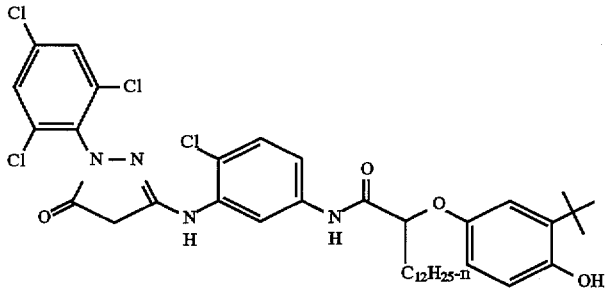

M-2

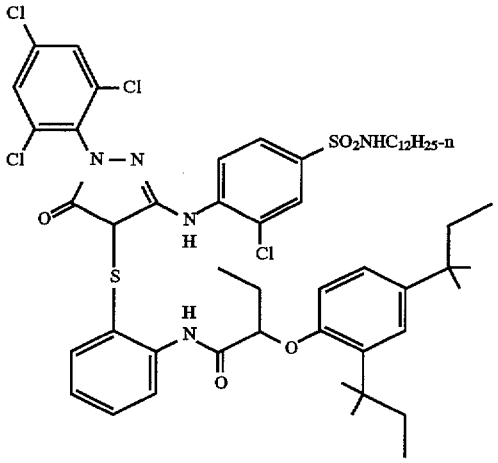

M-3

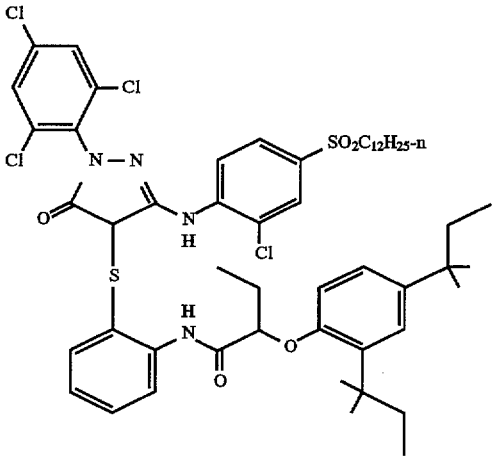

-continued
M-4
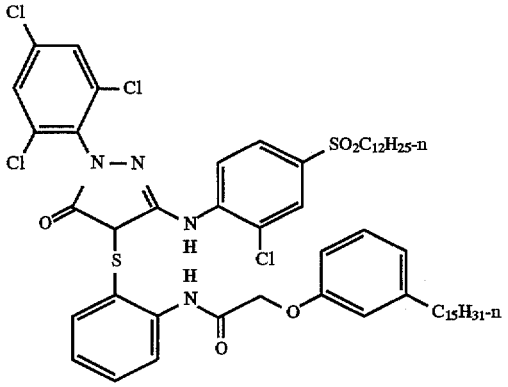
M-5
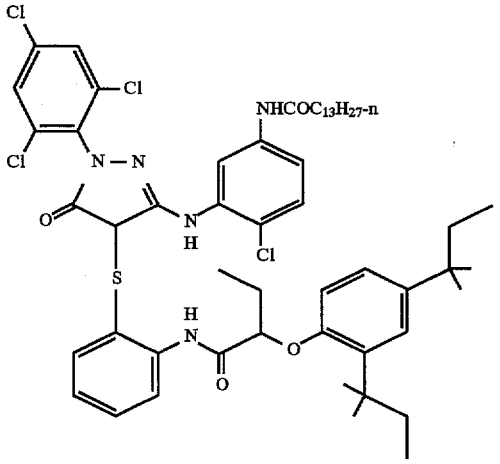
M-6
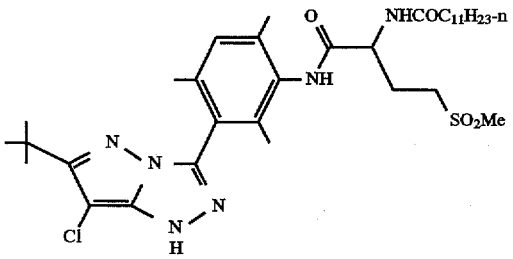
M-7
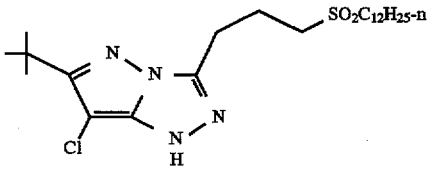
M-8
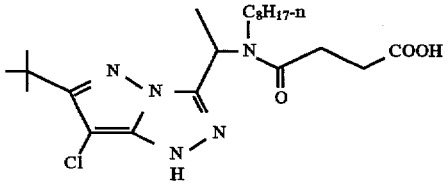

-continued

M-9

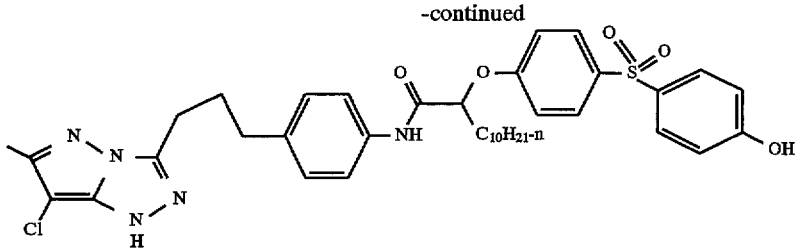

M-10

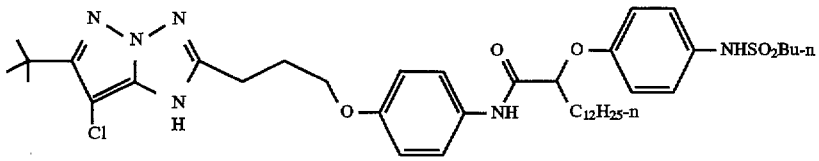

M-11

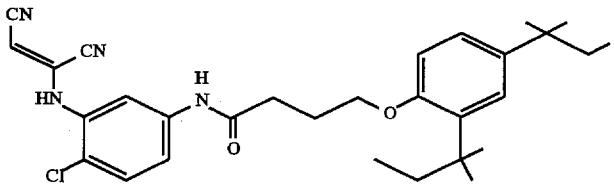

M-12

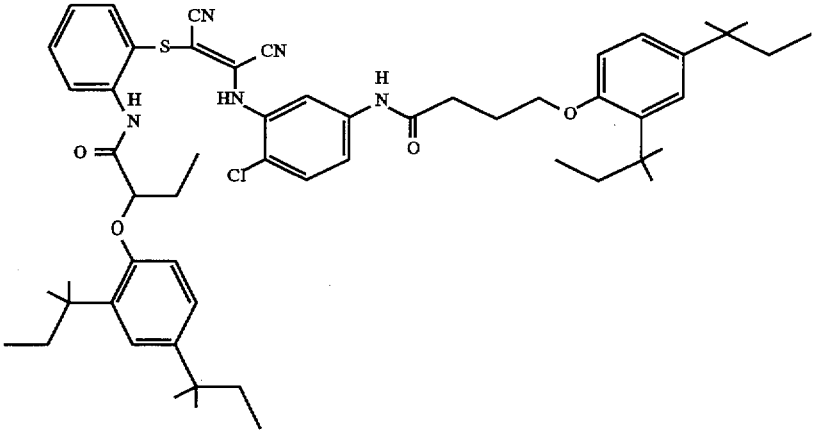

As to the amount of the above described stabilizers which may be used in the present invention, typically the amount of a compound of formula (A) will range from about 0.8 to about 8.0 moles per mole of the magenta coupler with which it is associated, or 2.0 to 6.5, or particularly 2.5 to 5.0 moles per mole of the magenta coupler. Preferably the weight ratio of the compound of formula (A) to the magenta coupler with which it is associated, is between 1/1 to 1/20 (preferably 1/1 to 1/6). As to the amount of the magenta coupler with which a compound of formula (A) is assocated, the magenta coupler is typically coated at from 0.20 to 0.40 mmol/$m^2$, and more preferably from 0.25 to 0.35 mmol/$m^2$. Stabilizers of the present invention may be used with or without additional stabilizers.

The photographic elements of the present invention can be black and white elements (for example, using magenta, cyan and yellow dye forming couplers), single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure,* September 1994, Number 365, Item 36544, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the photographic elements may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

It is also contemplated that the concepts of the present invention may be employed to obtain reflection color prints as described in *Research Disclosure,* November 1979, item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like. For example, the silver halide used in the photographic elements of the present invention may contain at least 90% silver chloride or more (for example, at least 95%, 98%, 99% or 100% silver chloride). In the case of such high chloride silver halide emulsions, some silver bromide may be present but typically substantially no silver iodide. Substantially no silver iodide means the iodide concentration would be no more than 1%, and preferably less than 0.5 or 0.1%. In particular, in such a case the possibility is also contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % figures are mole %.

The type of silver halide grains preferably include polymorphic, cubic, and octahedral. The grain size of the silver halide may have any distribution known to be useful in photographic compositions, and may be ether polydipersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I,* Section I.B.(3) (page 503).

The silver halide grains to be used in the invention may be prepared according to methods known in the art, such as those described in *Research Disclosure I* and James, *The Theory of the Photographic Process.* These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, ruthenium, rhodium, phosphorous, or combinations thereof. Chemical sensitization is generally carried out at pAg levels of from 5 to 10, pH levels of from 5 to 8, and temperatures of from 30° to 80° C., as illustrated in *Research Disclosure,* June 1975, item 13452 and U.S. Pat. No. 3,772,031.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored or generated image (such as a computer stored or generated image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor, *The Theory of the Photographic Process,* 4th Edition, Macmillan, New York, 1977. In the case of processing a negative working element, th element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog unexposed silver halide (usually chemical or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium or potassium salts of ferric ethylenediaminetetraacetic acid), water-soluble persulfates (e.g., Potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The present invention will be further described in the examples below.

A. SYNTHESIS OF GREEN Dmin CONTROL AGENTS OF FORMULA (A)

Synthesis of S-4

Reacton of 4-t-octylphenol with Diethyl chlorophosphate in Chloroform

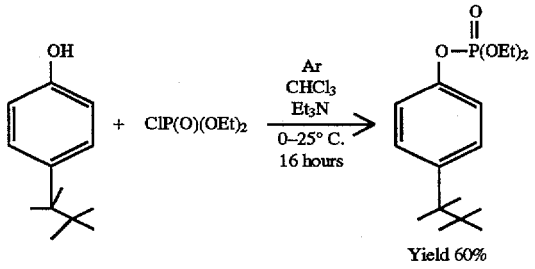

A 1 L 1-neck flask equipped with a magnetic stirring bar, and a pressure equalized addition funnel was charged with chloroform (500 PAL), p-t-octylphenol (91.00 g, 441.04 mmol, and diethyl chlorophosphate (76.10 g, 441.04 mmol The resulting golden colored solution was chilled in an ice bath for 30 min while stirring under an argon atmosphere. A pressure equalized addition funnel was charged with triethylamine (99.6 mL, 749.77 mmol, 1.7 Eq.). The triethylamine was then added dropwise over 1.5 h to the reaction solution, and the gradual formation of a white precipitate ($Et_3N$:HCl) was noted. Upon completion of addition the ice bath was removed and the reaction was allowed to stir at room temperature (≈25° C.) overnight (16 h). Tlc analysis (5:1 ligroin 950/EtOAc) indicated one major component for product, a trace of starting material. The addition of 10% excess diethyl chlorophosphate did not drive the reaction to completion. The reaction solution was poured into 350 mL of ice water, mixture was transferred to separatory funnel, and layers separated. Aqueous layer was extracted with $CH_2CL_2$ (2×100 mL), pooled organic layers, washed with 1N HCl (1×300 mL), brine (1×300 mL), and dried ($MgSO_4$), treated with Darco®, filtered and stripped to give a light amber colored oily liquid (140 g). Crude product was chromatographed over Silica gel 400–600μ and eluted with 10:1 ligroin 950/EtOAc, and obtained pure product as a colorless oil (91.12 g, 60%). $^1$H NMR (300 MHz) $CDCl_3$: δ 0.63 (s, 9H), 1.25 (m, 12H), 1.65 (s, 2H), 4.12 (dq, J=7.1 Hz, 4H), 7.04 (d, J=8.4 Hz, 2H), 7.25 (d, J=8.7 Hz, 2H). FDMS: Large m/e=342.

Synthesis of S-7

Reacton of 3-Pentadecylphenol with Diethyl chlorophosphate in Chloroform.

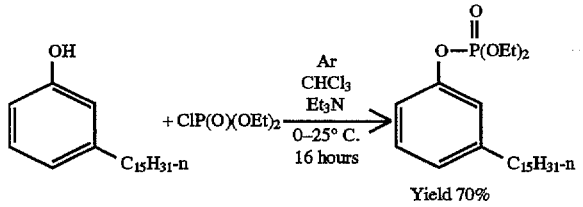

A 500 mL 1-neck flask equipped with a magnetic stirring bar, and a pressure equalized addition funnel was charged with chloroform (300 mL), pentadecylphenol (75.00 g, 246.29 mmol), and triethylamine (55.6 mL, 418.69 mmol, 1.7 Eq.). This solution was chilled in an ice bath for 30 min while stirring under an Argon atmosphere. A pressure equalized addition funnel was charged with diethyl chlorophosphate (46.75 g, 270.92 mmol, 1.1 Eq.). The chlorophosphate was then added dropwise over 1 h to the reaction solution. Upon completion of addition the ice bath was removed and the reaction was allowed to stir at room temperature (≈25° C.) overnight (16 h). Tlc analysis (5:1 ligroin 950/EtOAc) indicated one major spot for product, a trace of starting material and a small non-polar impurity. The reaction solution was poured into 350 mL of ice water, mixture was transferred to separatory funnel, and layers separated. Organic layer was washed with 1N HCl (1×200 mL), brine (1×200 mL), and dried ($K_2CO_3$), filtered and stripped to give a dark brown oily liquid (180 g). Redissolved crude product in EtOAc (1 L), treated with Darco®, and filtered through a pad of Silica gel, filtrate was stripped and resulting oil was immediately chromatographed over Silica gel 400–600μ and eluted with 10:1 ligroin 950/EtOAc, and obtained pure product as a colorless oil (76.02 g, 70%). $^1$H NMR (300 MHz) $CDCl_3$: δ 0.82 (t, J=6.9 Hz, 3H), 1.18 (br.s, 24H), 1.31 (t, J=7.3 Hz, 6H), 1.57 (t, 7.2 Hz, 2H), 2.53 (t, J=7.9 Hz, 2H), 4.15 (dq, J=7.2 Hz, 4H), 6.99 (m, 2H), 7.02 (s, 1H), 7.21 (m, 2H). FDMS: large m/e=440.

B. PREPARATION OF THE PHOTOGRAPHIC ELEMENTS

Photographic elements were prepared by coating the following layers in the order listed on a resin-coated paper support:

| | |
|---|---|
| **1st layer** | |
| Gelatin | 3.23 g/m$^2$ |
| **2nd layer** | |
| Gelatin | 1.61 g/m$^2$ |
| Coupler (as shown in Table 1 below) | 0.33 mmol/m$^2$ |
| Coupler Solvent (as shown in Table 1 below) | 0.35 g/m$^2$ |
| Stabilizer (structure below) | 0.41 g/m$^2$ |
| Hydroquinone antioxidant | 0.06 g/m$^2$ |
| Blue sensitized AgCl emulsion | 0.17 g/m$^2$ |
| **3rd layer** | |
| Gelatin | 1.34 g/m$^2$ |
| 2-(2H-benzotriazol-2-yl)-4,6-bis-(1,1-dimethyl-propyl)phenol | 0.73 g/m$^2$ |
| Tinuvin 326 ™ (Ciba-Geigy) | 0.13 g/m$^2$ |
| **4th layer** | |
| Gelatin | 1.40 g/m$^2$ |
| Bis(vinylsulfonyl-methyl)ether | 0.14 g/m$^2$ |

The stabilizer used in the second layer for all examples of Table 1, was as follows:

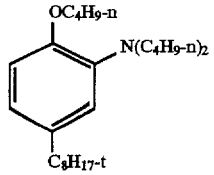

The formulae for couplers M-4 and M-2, which were used as shown in Table 1 below, are provided above. The formulae of comparative phosphate compounds C-1 through C-5, all indicated in Table 1 below, are as follows:

C-1

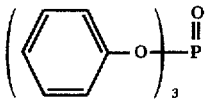

C-2

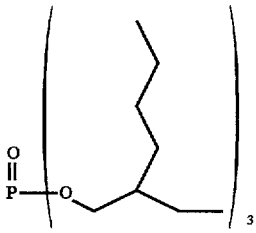

C-3

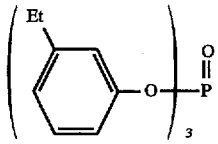

C-4

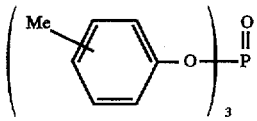

-continued

C-5

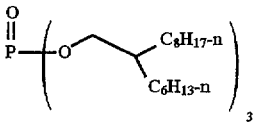

EXPOSING AND PROCESSING OF PHOTOGRAPHIC ELEMENTS

The photographic elements were given stepwise exposures to blue light and processed as follows at 35° C.:

| | |
|---|---|
| Developer | 45 seconds |
| Bleach-Fix | 45 seconds |
| Wash (running water) | 1 minute, 30 seconds |

The developer and bleach-fix were of the following compositions:

| | |
|---|---|
| **Developer** | |
| Water | 700.00 mL |
| Triethanolamine | 12.41 g |
| Blankophor REU ™ (Mobay Corp.) | 2.30 g |
| Lithium polystyrene sulfonate (30%) | 0.30 g |
| N,N-Diethylhydroxylamine (85%) | 5.40 g |
| Lithium sulfate | 2.70 g |
| N-{2-[(4-amino-3-methylphenyl) ethylamino]ethyl}methanesulfonamide sesquisulfate | 5.00 g |
| 1-Hydroxyethyl-1,1-diphosphonic acid (60%) | 0.81 g |
| Potassium carbonate, anhydrous | 21.16 g |
| Potassium chloride | 1.60 g |
| Potassium bromide | 7.00 mg |
| Water to make | 1.00 L |
| pH @ 26.7° C. adjusted to 10.04 +/− 0.05 | |
| **Bleach-Fix** | |
| Water | 700.00 mL |
| Solution of ammonium thiosulfate (54.4%) + ammonium sulfite (4%) | 127.40 g |
| Sodium metabisulfite | 10.00 g |
| Acetic acid (glacial) | 10.20 g |
| Solution of ammonium ferric ethylenediaminetetraacetate (44%) + ethylenediaminetetraacetic acid (3.5%) | 110.40 g |
| Water to make | 1.00 L |
| pH @ 26.7° C. adjusted to 5.50 +/− 0.10 | |

PHOTOGRAPHIC TESTS

The following photographic characteristics were determined for the dyes formed upon processing: $D_{max}$ (the maximum density to light); Speed (the relative log exposure required to yield a density to light of 1.0); and Contrast (the ratio (S-T)/0.6, where S is the density at a log exposure 0.3 units greater than the Speed value and T is the density at a log exposure 0.3 units less than the Speed value).

The long term image stability characteristics were evaluated by subjecting step-exposed, processed strips to accelerated fade conditions particularly light and humidity. In particular, the exposed and processed strips were maintained at 75° C. for 4 weeks at 50% relative humidity and the increase in Dmin measured. The results appear below Table 1 under "4wk75C/50% Dmin Pinking".

TABLE 1

| Coupler | Solvent | 4 wk75C/50% Dmin Pinking | |
|---|---|---|---|
| M-4 | C-2 | 10 | Comparison |
| M-2 | C-3 | 5 | Comparison |
| M-4 | C-5 | 12 | Comparison |
| M-4 | C-1 | 9 | Comparison |
| M-4 | S-7 | 3 | Invention |
| M-4 | S-4 | 3 | Invention |
| M-2 | S-7 | 3 | Invention |

It will be seen from the results of Table 1 that when compounds of formula (A) were present with the magenta coupler, versus other phosphate compounds of the comparatives, Dmin pinking was considerably reduced. Additionally, light fade in each example was comparable.

Other multilayer photographic elements can be constructed using the compound of formula (A) and magenta couplers, as required by the present claims. In particular, specifically contemplated is the construction of multilayer elements of the structure described in *Research Disclosure* February 1995, Item 37038, published by Kenneth Mason Publications, Ltd., Dudley House, 12 North Street, Emsworth, Hampshire PO10 7DQ, ENGLAND, Section XVII, page 96–98 (this publication will be referenced below simply as "Item 37038"), including such elements using the alternative magenta layers I, II, and III, and alternative yellow layers I and II. In such elements a compound of formula (I) above (including specifically, any of those compounds S-1 to S-12 above), would be used as the coupler solvent in the magenta layer instead of the coupler solvent described in that publication. Particularly, a suitable multilayer element is that on pages 97–98 of Item 37038, but with the dibutyl phthalate in Layer 3 (Green Sensitive Layer) being replaced by 0.195 g/m$^2$ of compound S-7 above as the coupler solvent. The resulting element with S-7 is referenced here as "Multilayer A". Other suitable elements can be constructed as described on pages 97–98 of item 37038 but using in turn, each of the four Alternate Magenta Layers identified below to produce elements referenced herein as "Multilayer B" through "Multilayer E", respectively. Structures of the compounds identified in the layers below are those appearing in Item 37038, except for stabilizing compounds S-6 and S-7 of the present invention, the structures for which are given above):

| | |
|---|---|
| Alternate Magenta Layer I | |
| Layer 3: Green Sensitive Layer | |
| Gelatin | 1.230 g/m$^2$ |
| Green Sensitive Silver (Green EM-1) | 0.160 g Ag/m$^2$ |
| M-2 | 0.260 g/m$^2$ |
| S-7 | 0.260 g/m$^2$ |
| ST-5 | 0.360 g/m$^2$ |
| Dioctyl hydroquinone | 0.060 g/m$^2$ |
| Alternate Magenta Layer II | |
| Layer 3: Green Sensitive Layer | |
| Gelatin | 1.230 g/m$^2$ |
| Green Sensitive Silver (Green EM-1) | 0.150 g Ag/m$^2$ |
| M-7 | 0.280 g/m$^2$ |
| S-7 | 0.240 g/m$^2$ |
| Di(8-methylnononyl)phthalate | 0.240 g/m$^2$ |
| ST-8 | 0.140 g/m$^2$ |
| ST-19 | 0.140 g/m$^2$ |

-continued

| | |
|---|---|
| Alternate Magenta Layer III | |
| Layer 3: Green Sensitive Layer | |
| Gelatin | 1.270 g/m$^2$ |
| Green Sensitive Silver (Green EM-1) | 0.263 g Ag/m$^2$ |
| M-11 | 0.261 g/m$^2$ |
| S-6 | 0.261 g/m$^2$ |
| 2-(2-butoxyethoxy)ethyl acetate | 0.058 g/m$^2$ |
| ST-2 | 0.166 g/m$^2$ |
| Dioctyl hydroquinone | 0.039 g/m$^2$ |
| Phenylmercaptotetrazole | 0.001 g/m$^2$ |
| Alternate Magenta Layer IV | |
| Layer 3: Green Sensitive Layer | |
| Gelatin | 1.230 g/m$^2$ |
| Green Sensitive Silver (Green EM-1) | 0.160 g Ag/m$^2$ |
| M-12 | 0.237 g/m$^2$ |
| S-6 | 0.237 g/m$^2$ |
| ST-5 | 0.360 g/m$^2$ |
| Dioctyl hydroquinone | 0.060 g/m$^2$ |

Further elements can be constructed using the same structures as described above for each of the five elements of Multilayer A through Multilayer E, except in each, first replacing the Layer 1 ("Blue Sensitive Layer") as described on page 97 of Item 37038, with "Alternate Yellow Layer I" described on page 99 of that reference. Additional elements can be constructed using the same procedure but using "Alternate Yellow Layer II" on page 99 of Item 37038.

The preceding examples are set forth to illustrate specific embodiments of this invention and are not intended to limit the scope of the compositions or materials of the invention. It will be understood that variations and modifications can be effected within the spirit and scope of the invention.

We claim:

1. A silver halide photographic element comprising a magenta dye forming coupler of formula (D4), and a compound of formula (B) in association with the magenta dye forming coupler of formula (D4):

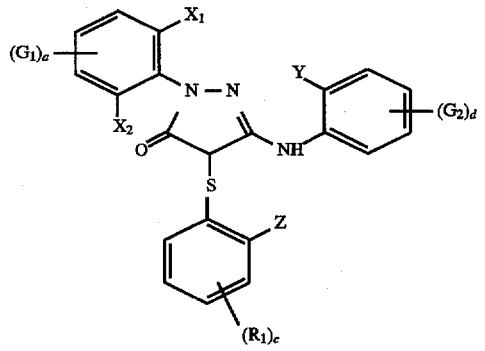

(D4)

wherein:

substituents $X_1$, $X_2$, Y, $G_1$ and $G_2$ are individually selected from the group of halogen, alkyl, alkoxy, aryloxy, acylamino, alkylthio, arylthio, sulfonamido, sulfamoyl, sulfamido, carbamoyl, diacylamino, alkoxycarbonyl, aryloxycarbonyl, alkoxysulfonyl, aryloxysulfonyl, alkylsulfonyl, arylsulfonyl, alkoxycarbonylamino, aryloxycarbonylamino, alkylureido, arylureido, acyloxy, nitro, cyano, trifluoromethyl and carboxy, and, in the case of $X_1$, $X_2$ and Y, hydrogen;

a, b and c are individually integers from 0 to 3;

$R_1$ is selected from any of those groups which $G_1$ may represent, and hydroxyl;

Z is selected from carbamoyl, alkoxysulfonyl, aryloxysulfonyl, alkylsulfonyl, arylsulfonyl, alkoxycarbonyl, aryloxycarbonyl, sulfamoyl, acyloxy, nitro, cyano, and an amine group of the formula:

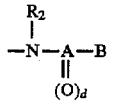

wherein:

$R_2$ is selected from the group consisting of hydrogen, alkyl, alkenyl, aryl, acyl, and heterocyclic;

A is carbon or a sulfur, and d is 1 when A is carbon and 1 or 2 when A is sulfur;

B is selected from alkyl, aryl, and heterocyclic groups, such group B bonded to A by an atom of oxygen, nitrogen, sulfur, or carbon of the group B, wherein in the case of a carbon bond, B has the formula:

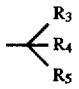

wherein $R_3$, $R_4$, and $R_5$ individually are selected from hydrogen, halogen, alkyl, aryl, heterocyclic group and W, wherein, W is selected from —$OR_6$, —$SR_6$, and —$NR_7R_8$, wherein $R_6$ is selected from alkyl, aryl, and heterocyclic groups, and $R_7$ and $R_8$ individually are selected from hydrogen, alkyl, aryl, acyl, alkylsulfonyl, arylsulfonyl and heterocyclic group, provided that when A is carbon at least one of $R_3$, $R_4$, and $R_5$ is not hydrogen or alkyl and provided that two of $R_3$, $R_4$, and $R_5$ may join to form an aliphatic, aromatic or heterocyclic ring;

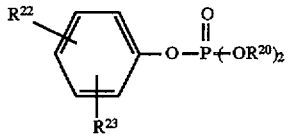

(B)

wherein:

each $R^{20}$ independently represents an alkyl, alkenyl, or heteroaryl group;

$R^{22}$ and $R^{23}$ are, independently, hydrogen, an alkyl group, alkenyl group, alkoxy group, aryloxy group, alkyl silyl group, an alkyl silyloxy group, alkylthio group, arylthio group, amido group, a carbamoyl group, an alkyl sulfonamido group, aryl sulfonamido group, aryl sulfuryl group, or alkyl sulfuryl group;

wherein the total number carbon atoms in $R^{22}$ and $R^{23}$ together is at least 5;

provided that $R^{22}$ and $R^{23}$ are not both hydrogen.

2. A photographic element according to claim 1 wherein the magenta dye forming coupler is located in a layer of the element and the compound of formula (A) is located in the same layer as the magenta dye forming coupler.

3. The element of claim 1 wherein the total number of carbon atoms in $R^{22}$ and $R^{23}$ together is 5 to 30.

4. The element of claim 1 wherein at least one of $R^{22}$ and $R^{23}$ is an alkyl group.

5. The element of claim 4 wherein $R^{22}$ is an unsubstituted alkyl group selected from the group consisting of —$C_8H_{17}$-n, —$C_{15}H_{31}$-n, —$C_{12}H_{25}$-n, —$OCH_2CH(C_2H_5)CH_2CH_2CH_2CH_3$, —$OC_8H_{17}$-n, —$OCH_2CH_2OCH_2CH_2OCH_2CH_3$, —$C_4H_9$-t, and —$C_8H_{17}$-t.

* * * * *